US006390850B2

(12) United States Patent
Yoshimura et al.

(10) Patent No.: US 6,390,850 B2
(45) **Date of Patent: *May 21, 2002**

(54) CARD CONNECTOR HAVING AN IMPROVED GROUNDING MEMBER

(75) Inventors: Yoji Yoshimura; Yoshihisa Yamamoto, both of Yokohama; Takashi Futatsugi, Tokyo, all of (JP)

(73) Assignee: The Whitaker Corporation, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/311,399

(22) Filed: May 13, 1999

(30) Foreign Application Priority Data

Jun. 3, 1998 (JP) ..... 10-154028

(51) Int. Cl.[7] ..... H01R 13/648
(52) U.S. Cl. ..... 439/607
(58) Field of Search ..... 439/108, 607, 439/609, 541.5, 608, 610

(56) References Cited

U.S. PATENT DOCUMENTS 5,470,259 A * 11/1995 Kaufman et al. ..... 439/607
5,636,999 A * 6/1997 Hirai et al. ..... 439/79
5,660,558 A * 8/1997 Osanai et al. ..... 439/607
5,967,803 A * 10/1999 Ho ..... 439/541.5

OTHER PUBLICATIONS

Japanese Publication No. 140779/90 no month.

Japanese Publication No. 2555656/96 no month.

* cited by examiner

*Primary Examiner*—Neil Abrams
*Assistant Examiner*—Javaid Nasri

(57) ABSTRACT

A card connector provides for reliable grounding and, at the same time, makes it possible to simplify the mounting, maintenance and servicing operations. Card connector (10) comprises a main body (11) including a dielectric housing (13) accommodating multiple electrical contacts (12) and a grounding member (14) that is fabricated separately from the main body (11) and is secured thereto. The grounding member (14) has tabs (17) that electrically connect with an outer surface of a card inserted in the card connector (10) and connecting sections (16), the purpose of which is to electrically connect with electrical circuitry of a circuit board. The grounding member (14) can be latchably attached to the main body (11) that is mounted to the circuit board (100), and if necessary, it can be removed, thus providing access to connecting sections **(12*a*) of electrical contacts (12)**.

9 Claims, 5 Drawing Sheets

CARD CONNECTOR HAVING AN IMPROVED GROUNDING MEMBER

FIELD OF THE INVENTION

The present invention relates to card connectors mounted on circuit boards for the purpose of forming electrical connection between a circuit board and a PC or other type of card, especially to card connectors comprising grounding devices intended for the grounding of a portion of the card.

BACKGROUND OF THE INVENTION

In recent years, cards have become a medium of choice for memory or other applications in notebook PCs, portable terminals and other computer equipment. These units are equipped with card connectors that form electrical connection with memory cards inserted therein. Card connectors are usually arranged and mounted parallel to the circuit boards. Card connectors have multiple electrical contacts that can be electrically connected to conductive pads provided on the cards and be electrically connected to circuitry on circuit boards by soldering or some other method.

Depending on a specific application of the card and card connector, they must be equipped with a grounding structure providing for a ground connection with an outer surface of the card. Such a grounding structure comprises a main ground plate, a spring-loaded tab forming a spring-loaded contact with the ground-connection section located on the outer surface of the card and a connecting device providing for the mounting of the card connector to the circuit board. An example of the card connector of this type can be found in Japanese Utility Model Disclosure No. 2-140779 wherein the grounding structure has a plate secured at an upper surface of a housing. A portion of the plate is stamped and bent to form a spring-loaded tab. A connecting device is provided to form electrical connections between the plate and screws arranged at a back side of the housing, the purpose of which is to secure the housing on the circuit board. However, in many cases such a connecting device is not able to provide sufficient grounding needed for signal transmission, especially in such applications as the PCMCIA standard based card buses where requirements for the grounding are particularly high.

A card connector providing for high quality grounding is described in Japanese Patent Disclosure No. 8-255656. In the card connector disclosed therein, a grounding device comprises multiple tie-ins arranged at a distance from a grounding plate in a row parallel to a contact row. The tie-ins are electrically connected to a circuit board. However, in this card connector, it is difficult to check conditions of the connections of the mounting sections of the contacts intended for surface mounting that after the mounting are located inside the connector, and in the case of a faulty connection, it is difficult to fix the problem.

Therefore, the purpose of the present invention is to provide a card connector having a grounding structure providing for an optimum grounding connection that can be easily mounted and problems can be easily fixed.

SUMMARY OF THE INVENTION

The present invention is directed to a card connector intended for acceptance of a card that can be mounted on a circuit board comprising electrical contacts that can be joined to signal terminals of the card and connected to the circuit board and a grounding member having a contact section forming electrical connection with an outer surface of the card and a connecting section forming electrical connection with the circuit board and by the fact that a part comprising the connecting section that constitutes at least a part of the grounding member is secured in a detachable manner on a main body of the card connector, thus making it possible to maintain the electrical connections with the circuit board even when the part is removed.

BRIEF DESCRIPTION OF THE DRAWINGS

Embodiments of the present invention will now be described by way of example with reference to the accompanying drawings in which:

FIG. 5*a* is an exploded perspective view before assembly of the card connector, and FIG. 5*b* is a perspective view after assembly of the card connector.

FIG. 6*a* is a part perspective view, and FIG. 6*b* is a cross-sectional view showing a main body and a circuit board.

DETAILED DESCRIPTION OF THE INVENTION

Figure 1:
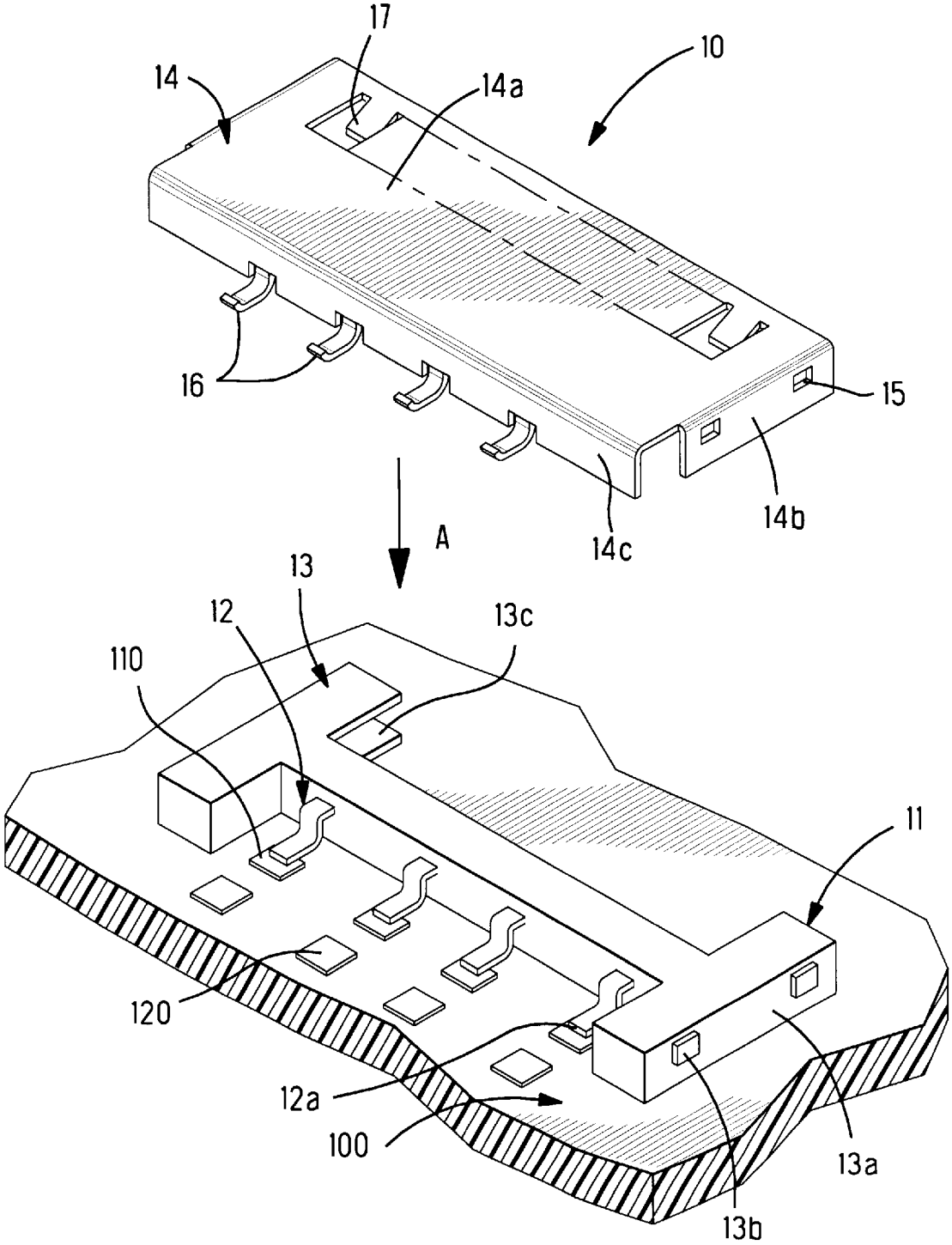
FIG. 1 is an exploded perspective view of a card connector according to the present invention.

As can be seen from FIG. 1, card connector 10 has a main body 11 including multiple electrical contacts 12 and a dielectric housing 13 containing the electrical contacts 12, and a grounding member 14 that can be secured on the main body 11. The electrical contacts 12 comprise connecting sections 12*a* that are intended to be connected by surface mounting technique to conductive pads 110 on circuit board 100. The electrical contacts 12 are arranged in the housing 13 in a row. The housing 13 has at its front side a card-receiving cavity 13*c* in which contact sections of the electrical contacts 12 (not shown) are intended to electrically connect with electrical contacts of a card. On both lateral sides 13*a* of the housing 13, latching lugs 13*b* are located, the purpose of which is to latchably mount the grounding member 14 onto housing 13.

The grounding member 14 is formed by stamping and forming a single piece of a metal sheet and it includes a main flat section 14*a*, side sections 14*b* and a back section 14*c* that is to be disposed against a back side of the housing 13. The side sections 14*b* have openings 15 that fit over the latching lugs 13*b* of the housing 13. The back section 14*c* has resilient connecting tabs 16 that electrically connect with ground conductive pads 120 on the circuit board 100. The resilient connecting tabs 16 have a configuration and dimensions providing the resiliency thereof. In addition, the main flat section 14*a* has contact tabs 17 formed therein that extend downward.

The grounding member 14 can be secured on the main body 11 of the card connector 10 that is mounted on the circuit board 100 by moving it in the direction indicated by arrow A in FIG. 1. The grounding member 14 is placed directly over the housing 13 and the contact tabs 17 on the main flat section 14*a* extend within the card-receiving cavity 13*c* so that they engage with an outer surface of the card that is inserted in the card-receiving cavity 13*c*. It should be noted that due to the engagement between the latching lugs 13*b* and the openings 15, the grounding member 14 is precisely placed on the housing 13, and contact tabs 17 reliably form electrical engagement with a card surface exactly at the required place thereof. When the grounding member 14 is secured on the housing 13, the resilient connecting tabs 16 of the grounding member 14 are resiliently pressed against the ground conductive pads 120 on the circuit board 100 thereby forming spring-loaded electrical connection therewith. Therefore, a highly-reliable grounding connection can be established between the card and the circuit board.

One of the advantages of card connector 10 is the fact that the grounding member 14 and the main body 11 can be handled separately. This makes it possible to visually determine if the electrical contacts 12 are electrically connected with conductive pads 110; and, if electrical connection of any electrical contact does not appear to be proper, it can be easily corrected before mounting the grounding member 14 onto housing 13. In addition, even if a poor electrical connection is discovered after mounting the grounding member 14 onto the housing, the grounding member 14 can be removed without affecting the state of the main body 11, after which electrical connections can be visually inspected and the problem can be easily fixed. Below, explanations concerning several other embodiments of the present invention providing similar effects are described.

Figure 2:
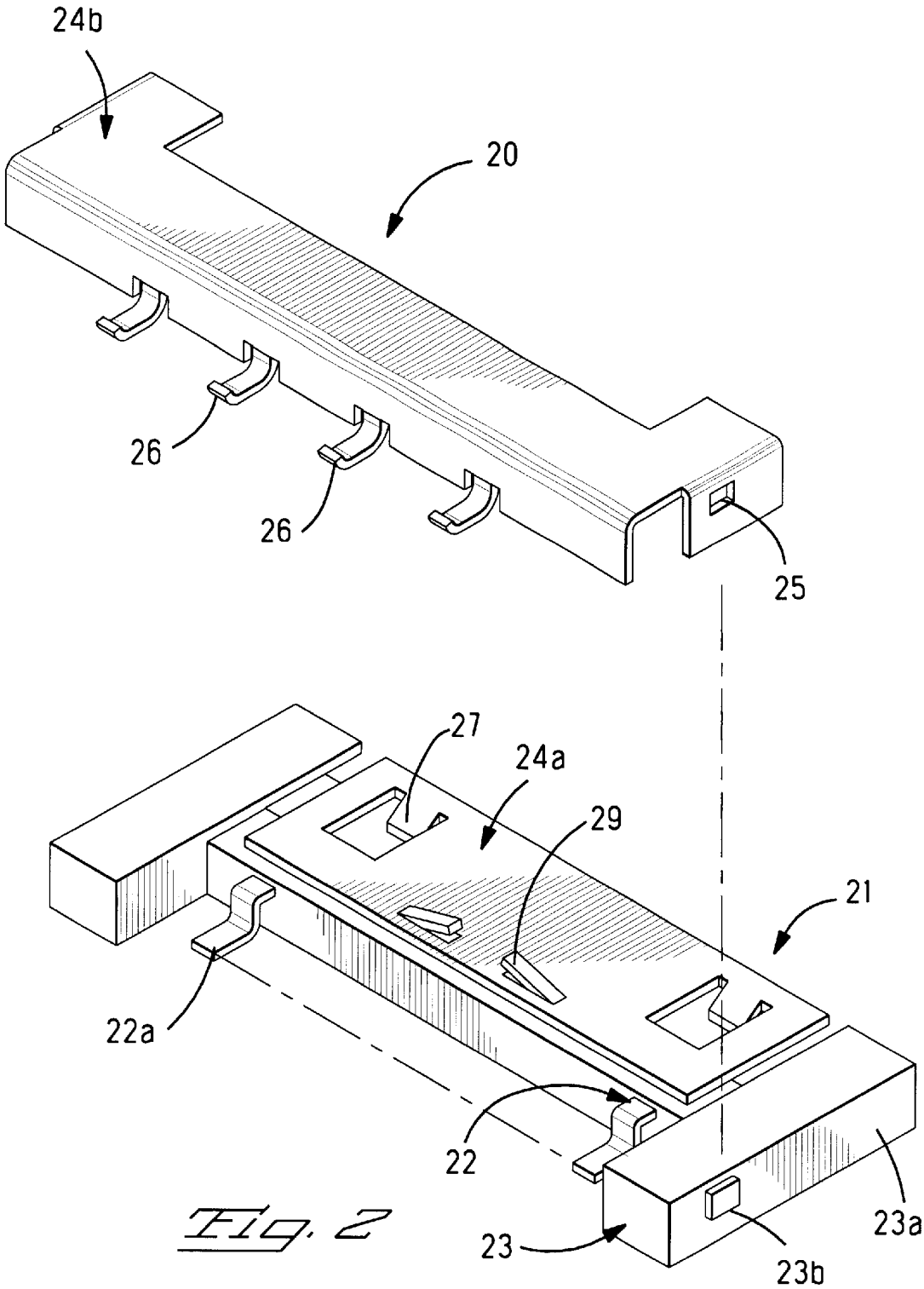
FIG. 2 is an exploded perspective view of an alternative embodiment of the card connector of the present invention.

As can be seen from FIG. 2, card connector 20 according to an alternative embodiment of the present invention has a main body 21 including a dielectric housing 23 accommodating multiple electrical contacts 22 having connecting sections 22*a* that are intended to be connected by surface mounting technique and a grounding plate 24*a*, and a grounding member 24*b*. The grounding plate 24*a* has tabs 27 extending inwardly, the purpose of which is to form electrical connection with the card inserted in the card connector. The grounding member 24*b* is made separately from the main body and it has latching openings 25 intended to be engaged with the latching lugs 23*b* provided on both lateral sides 23*a* of the housing 23. Therefore, the grounding member 24*b* can be freely attached to the main body 21. The grounding member 24*b* has resilient connecting tabs 26 that are intended to form spring-loaded electrical connection with the circuit board (not shown).

The difference of the embodiment of FIG. 2 from the embodiment of FIG. 1 resides in the method of attachment of the grounding plate 24*a* that is a part of the grounding structure to the main body 21. The grounding plate 24*a* has spring-loaded tabs 29 extending upward. The spring-loaded tabs 29 form spring-loaded electrical connection with the grounding member 24*b* when it is latched on the main body 21. This accomplishes the formation of the grounding structure. Since, as was mentioned above, the grounding member 24*b* comprising the connecting tabs 26 can be installed on and removed from the main body 21, the effect of this embodiment is similar to that of the embodiment of FIG. 1.

Figure 3:
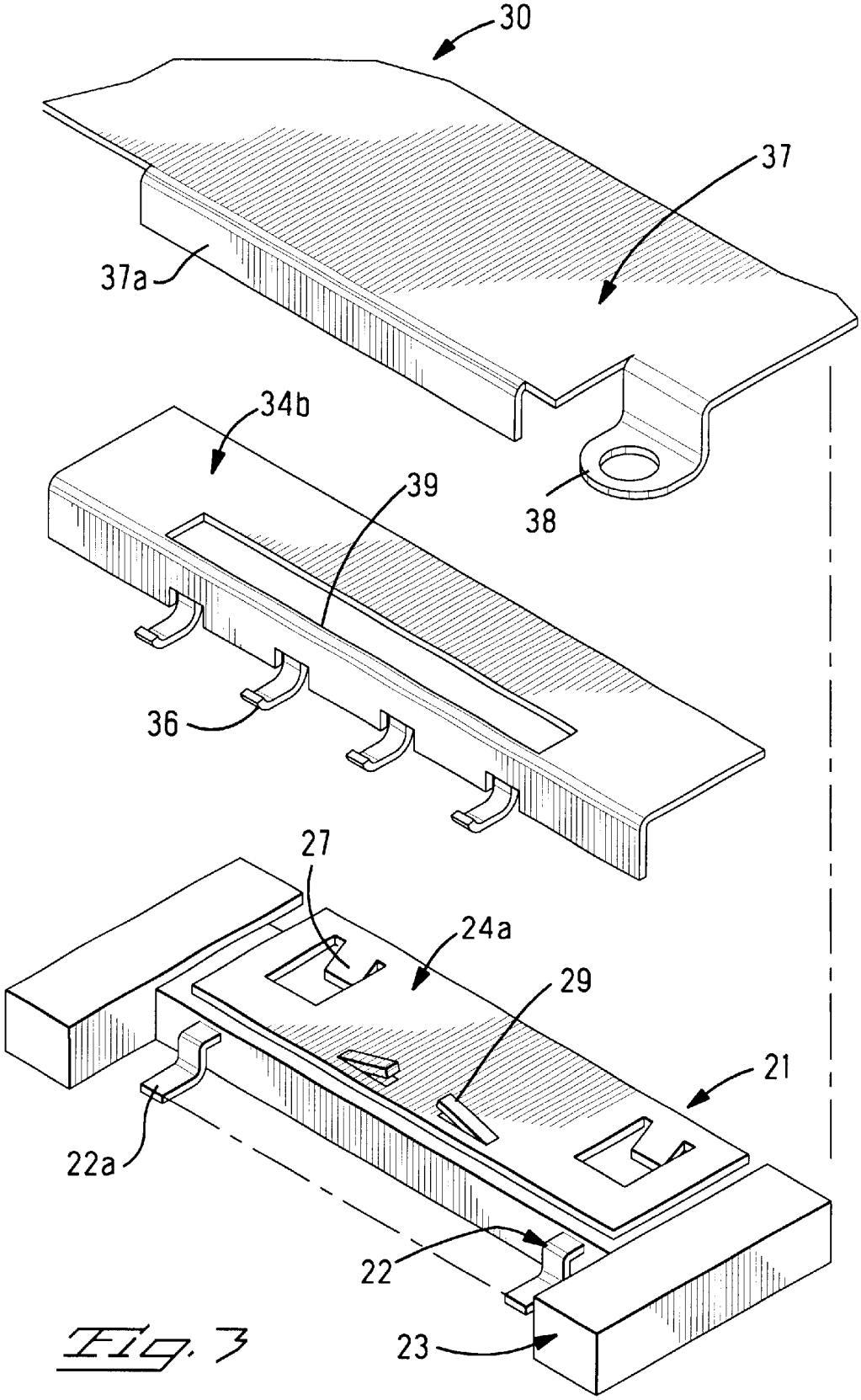
FIG. 3 is an exploded perspective view of another embodiment of the card connector of the present invention.

Card connector 30 shown in FIG. 3 is a modification of the embodiment of FIG. 2. Since its main body 21 has basically the same design as the that of the embodiment of FIG. 2 and all reference numbers are the same, the explanation concerning these parts are omitted. According to the embodiment of FIG. 3, the grounding member 34*b* comprising the resilient connecting tabs 36 does not have means of attachment to the housing 23, but it is secured over the main body 21 by frame 37 that has means 38 in the form of an L-shaped tab having a hole for the attachment to the circuit board (not shown). Namely, when the frame 37 is attached to the circuit board via a screw through the hole of the L-shaped tab 38, the grounding member 34*b* is pressed against the main body, thus forming the grounding structure by establishing electrical connection between the grounding plate 24*a* and the grounding member 34*b*. For a proper alignment of the components, the frame 37 has a projection 37*a* fitting in an elongated slot 39 provided in the grounding member 34*b*. The frame 37 may be equipped with a card-ejection mechanism. Since the grounding device in this embodiment can be installed on and removed from the main body, the same effect as in the embodiments described above can be achieved.

Figure 4:
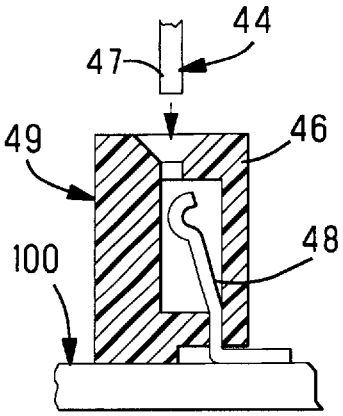
FIG. 4 is a cross-sectional view showing a further embodiment which is a modification of the embodiments shown in FIGS. 1–3.

As can be seen from FIG. 4, a further embodiment is a modification of the part of the grounding structure related to the connection to the circuit board. According to this embodiment, the grounding member 44 does not have resilient connecting tabs forming spring-loaded connections with the circuit board 100. Instead, it comprises a tab-connection member 47. When the grounding member 44 is secured on the card connector (not shown), tab-connection member 47 is inserted in the receptacle connector 49 that is mounted on the circuit board 100, thereby forming the grounding path to the circuit board 100 via the cantilever contact 48. In such a case, the housing 48 is not necessarily required and the number of cantilever contacts 48 may vary from one to several. This is another possible configuration of the removable grounding member 44. This configuration has more parts but it provides for a reliable electrical connection.

Figure 5A:
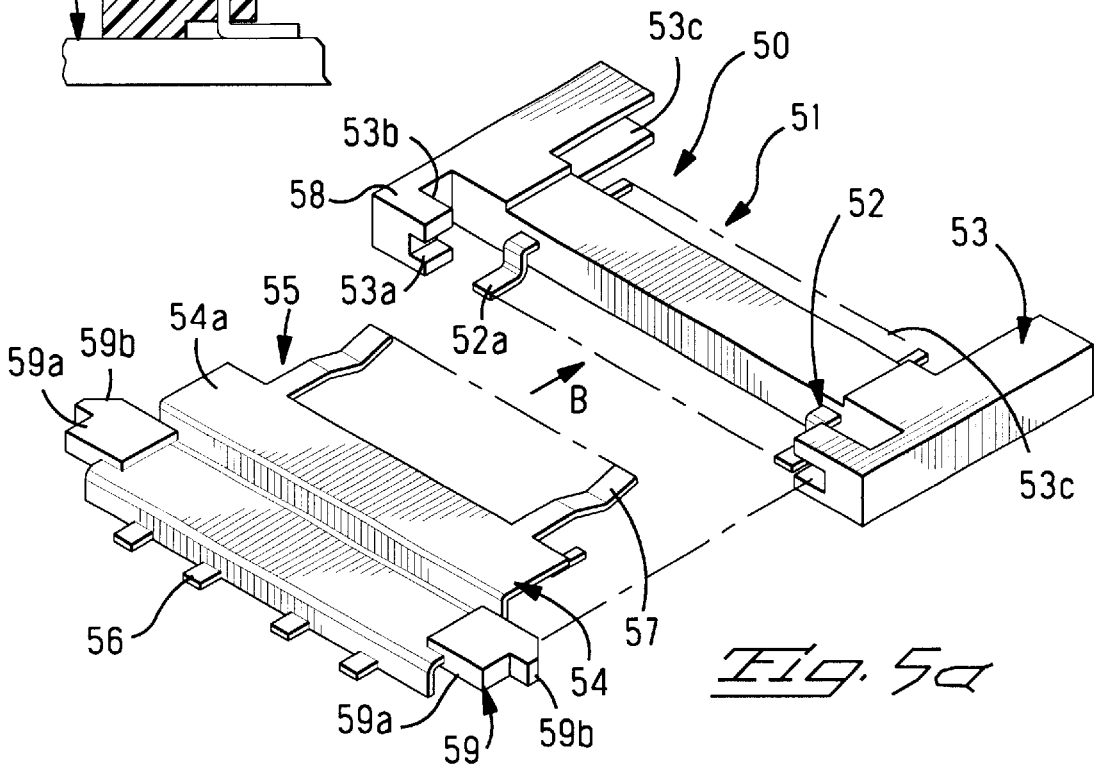
FIGS. 5*a* and 5*b* are perspective views of an additional embodiment of the card connector of the present invention.
Figure 5B:
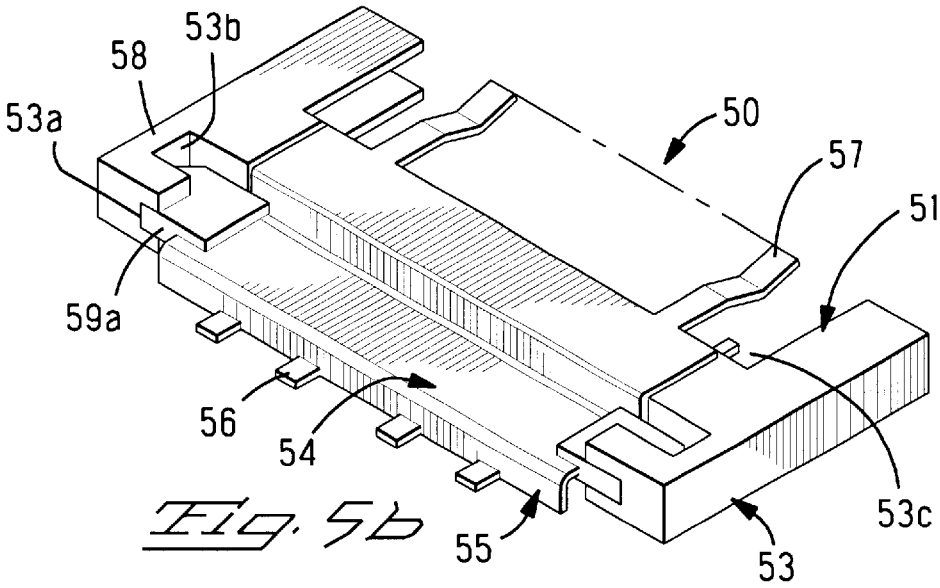

FIGS. 5*a* and 5*b* show an additional embodiment of the present invention. As can be seen from FIG. 5*a*, card connector 50 has main body 51 comprising electrical contacts 52 having surface-mounted connecting sections 52*a*, dielectric housing 53 accommodating the electrical contacts, and removable grounding assembly 55 that can be mounted on the main body 51. The grounding assembly 55 has a grounding member 54 and dielectric mounting members 59. The grounding member 54 is similar to the grounding members described above, and it is either fabricated by insert molding as an integral unit with the dielectric mounting members 59 or they are attached thereto by a conventional mechanical method. The grounding member 54 has contact tabs 57 for electrical connection with the outer surface of the card and the connecting tabs 56 forming spring-loaded electrical connection with the ground conductive pads of the circuit board (not shown). As can be seen from FIG. 5*a*, the contact tabs 57 extend forward from main plate 54*a* of the grounding member 54.

Sections 59*a* of the mounting members 59 have lugs 59*b* protruding therefrom. At both ends of the back of housing 53, latching members 58 are provided that have horizontal grooves 53*a* and latching notches 53*b* extending in a vertical direction. As can be seen from FIGS. 5*a* and 5*b*, the grounding assembly 55 is mounted on the main body 51 from its back end in a horizontal direction (as shown by arrow B) whereby sections 59*a* of the mounting members 59 slide in the grooves 53*a* as alignment means, after which the lugs 59*b* become engaged with the latching notches 53*b*, thereby latching the grounding assembly 55 to the main body 51. The mounting of the grounding assembly 55 can be carried out after the completion of the surface mounting of the main body 51. Because of this, the connecting tabs 56 form spring-loaded electrical connection with the ground conductive pads of the circuit board while performing some wiping action therebetween, and the contact tabs 57 become located inside the card-receiving cavity 53*c*. If necessary, after the completion of the assembly, the grounding assembly 55 can be removed, thus providing access for the inspection of the connecting sections 52*a* of the contacts 52 to their respective conductive pads on the circuit board.

Figure 6A:
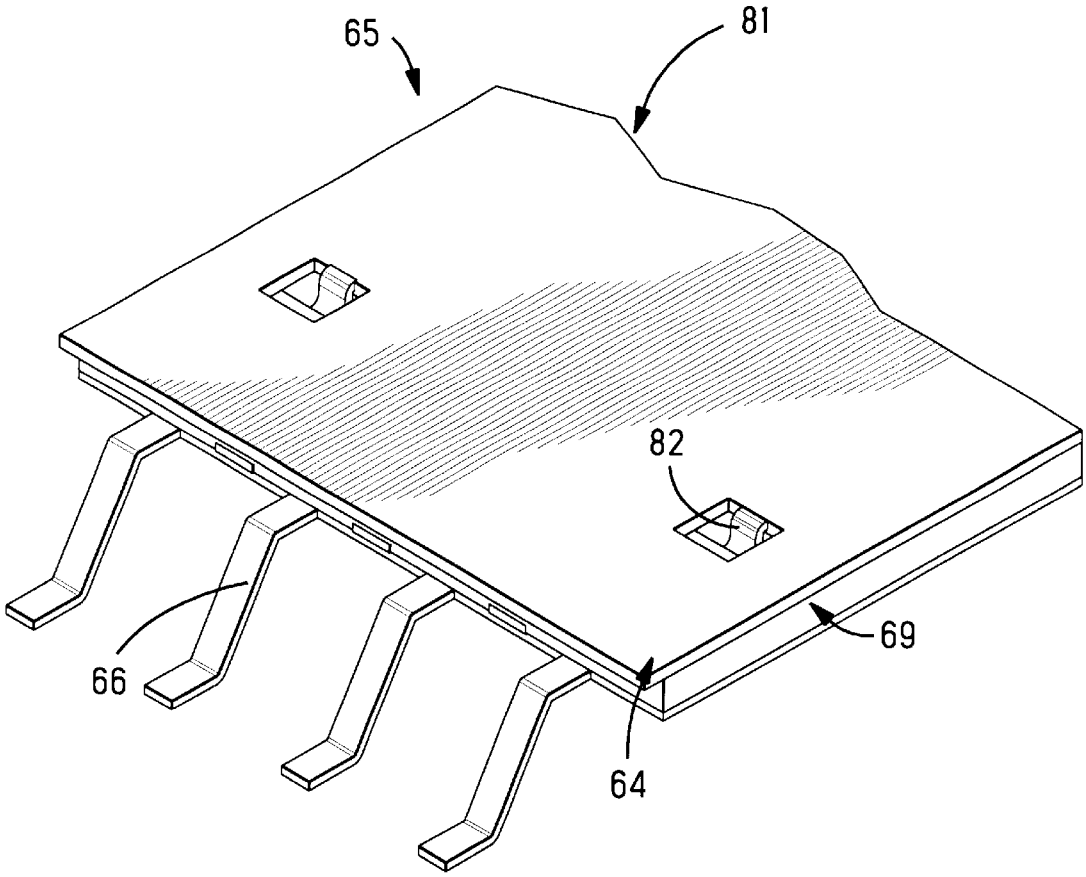
FIGS. 6*a* and 6*b* show a grounding assembly used in the card connector according to a still further embodiment of the present invention.
Figure 6B:
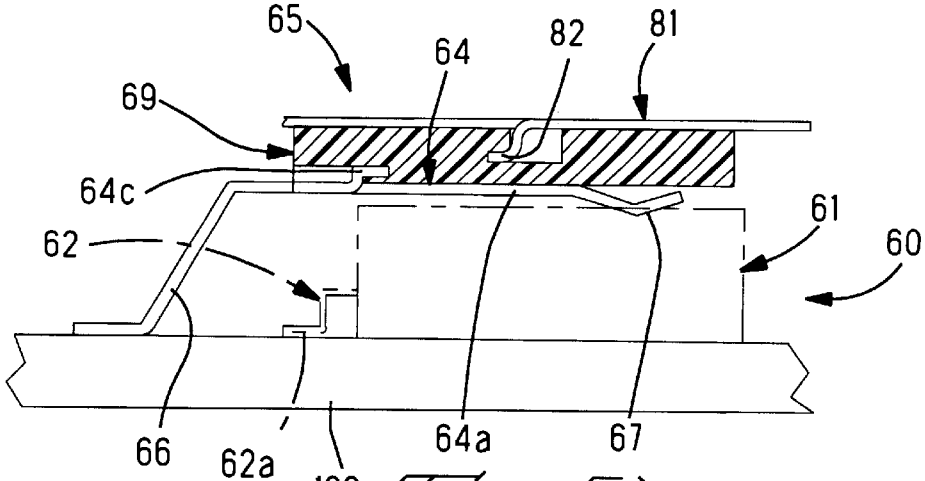

FIGS. 6*a* and 6*b* show a grounding plate assembly as a still further embodiment of card connector 60. As can be seen from FIGS. 6*a* and 6*b*, the grounding assembly 65 has a grounding member 64 and a supporting member 69 supporting it, and it can be secured on top of main body 61. The grounding member 64 is located under the supporting member 69. As can be seen, the grounding member 64 is secured to the supporting member 69 by means of a tab 64*c*; however, it may be also secured by insert molding or any other mechanical method that is known. The grounding unit 64 has contact tabs 67 extending forward from main plate 64*a* that are intended to form electrical connection with the card and the connecting tabs 66 forming spring-loaded electrical connection with the ground conductive pads of the circuit board.

The embodiment of FIGS. 6*a* and 6*b* is basically similar to the embodiment of FIGS. 5*a* and 5*b*, with the exception that the grounding plate assembly 65 that is arranged on the top of the main body 61 is not attached to it, but rather to the a frame 81 separate from the main body 61. The supporting member 69 is secured to the frame 81 by tabs 82. It also may be secured by any other known method. The frame 81 is mounted on the circuit board, and in many cases it is mounted after the installation of the circuit board. Therefore, the ability to install the frame 81 after the mounting of the card connector 60 on the circuit board was completed facilitates worker operations. It also makes it possible to remove the frame 81, thus exposing the connecting sections 62*a* of the electrical contacts 62 for inspection and maintenance. An important point in these mounting arrangements is that the grounding plate assembly 65 can be mounted directly on the main body 61 without any mechanical means.

Detailed explanations concerning the embodiments of the present invention have been provided; however, these embodiments are only examples and do not limit the scope of the invention. The present invention also covers various modifications that may be introduced by experts in the field.

The present invention is directed to a connecting section that forms electrical connection with the a circuit board at least a portion of which constitutes a grounding member that is attached to a main body of a card connector in such a manner that it can be removed while the electrical connections between the electrical contacts and the circuit board are maintained. Therefore, the state of connection between the electrical contacts and conductive pads on the circuit board can be easily inspected and, if a poor electrical connection is found, the problem can be easily fixed. If a poor electrical connection is found after completion of installation of the card connector, the grounding member can be removed without affecting the mounting of the main body of the card connector, and the electrical connection can be repaired, thus considerably simplifying the assembly and maintenance operations.

What is claimed is:

1. A card connector for mounting onto a circuit board and for receiving a card, comprising:

a dielectric housing having a card-receiving cavity for receiving the card and latching lugs on an outer surface;

electrical contacts mounted on the dielectric housing and having contact sections disposed in the card-receiving cavity and connecting sections for electrical connection to conductive members of the circuit board; and a grounding member mounted on the dielectric housing and having contact tabs extending downward within the card-receiving cavity for electrical connection with the card when received therein, and resilient connecting tabs for electrical connection with ground conductive members on the circuit board, and latch members having openings for engaging the latching lugs to precisely align and urge the connecting tabs against ground conductive members of the circuit board.

2. A card connector as claimed in claim 1, wherein the latch members comprised mounting members on the grounding member having sections and lugs disposed in grooves and latching notches in the dielectric housing.

3. A card connector as claimed in claim 1, wherein the connecting tabs of the grounding member electrically connect with cantilever contacts on the circuit board.

4. The card connector as claimed in claim 1 wherein the grounding member substantially covers the dielectric housing.

5. The card connector as claimed in claim 1 wherein the latch members are located on a side section of the grounding member.

6. The card connector as claimed in claim 1 wherein the latching lugs are located on lateral sides of the housing.

7. The card connector as claimed in claim 1 wherein the contact tabs extend from a main flat section of the grounding member into the card-receiving cavity.

8. The card connector of claim 1 wherein the connecting tabs extend from a back section toward the conductive members on the circuit board.

9. A grounding member for mounting to a housing of an electrical connector comprising:

a main flat section;

a back section extending from a first end of the main flat section at an angle;

a side section extending from a second end of the main flat section at an angle;

contact tabs extending from the main flat section into a card-receiving cavity of the housing;

connecting tabs extending from the back section for contacting conductive members on a circuit board; and, a latch member disposed on the side section having an opening formed therein for engaging lugs on the housing to align and urge the connecting tabs against the conductive contact members on the circuit board.

* * * * *